US010580336B2

(12) United States Patent
Jang et al.

(10) Patent No.: US 10,580,336 B2
(45) Date of Patent: Mar. 3, 2020

(54) DISPLAY DRIVER DEVICE

(71) Applicant: SAMSUNG ELECTRONICS CO., LTD., Suwon-si, Gyeonggi-Do (KR)

(72) Inventors: Minhwa Jang, Hwaseong-si (KR); Chulho Choi, Seoul (KR); Hyunje Park, Seoul (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/648,923

(22) Filed: Jul. 13, 2017

(65) Prior Publication Data

US 2018/0018910 A1 Jan. 18, 2018

(30) Foreign Application Priority Data

Jul. 14, 2016 (KR) ..... 10-2016-0089381
Dec. 23, 2016 (KR) ..... 10-2016-0177559

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01); *G09G 2300/0421* (2013.01); *G09G 2310/08* (2013.01); *G09G 2330/12* (2013.01)

(58) Field of Classification Search
CPC ..... G09G 3/006; G09G 3/2092; G09G 2300/0421; G09G 2330/12; G09G 2310/08
See application file for complete search history.

(56) References Cited

U.S. PATENT DOCUMENTS

| | | | | |
|---|---|---|---|---|
| 8,786,814 | B2 | 7/2014 | Kim et al. | |
| 9,349,683 | B2 | 5/2016 | Jung et al. | |
| 9,412,292 | B2 | 8/2016 | Lee | |
| 2015/0219947 | A1* | 8/2015 | Moh | G02F 1/13452 349/33 |
| 2016/0133550 | A1 | 5/2016 | Chen | |

FOREIGN PATENT DOCUMENTS

| | | |
|---|---|---|
| JP | 2015-172530 | 10/2015 |
| KR | 10-2007-0031042 | 3/2007 |
| KR | 10-2007-0071341 | 7/2007 |
| KR | 10-2013-0032113 | 4/2013 |
| KR | 10-1269289 | 5/2013 |
| KR | 10-2015-0078559 | 7/2015 |

* cited by examiner

*Primary Examiner* — Aneeta Yodichkas
(74) *Attorney, Agent, or Firm* — F. Chau & Associates, LLC

(57) ABSTRACT

A display driver device includes a timing controller, a display driver integrated circuit, a flexible printed circuit board, a connection line, and a test line. The timing controller includes an output pad unit. The display driver integrated circuit includes an input pad unit. The connection line is formed at the flexible printed circuit board to electrically connect the input pad unit with the output pad unit. The test line is formed at the flexible printed circuit board, and is used to provide a test signal to the input pad unit. The display driver device operates in a normal mode or operates in the test mode based on a test mode signal.

16 Claims, 14 Drawing Sheets

DISPLAY DRIVER DEVICE

CROSS-REFERENCE TO RELATED APPLICATIONS

This application claims priority from Korean Provisional Patent Application No. 10-2016-0089381 filed Jul. 14, 2016, and Korean Patent Application No. 10-2016-0177559 filed Dec. 23, 2016, in the Korean Intellectual Property Office, the entire contents of which are incorporated by reference herein.

TECHNICAL FIELD

Embodiments of the inventive concept described herein relate to a display driver device and more particularly, relate to a display driver device for operating in a test mode.

DISCUSSION OF THE RELATED ART

In general, various electronic devices, such as smartphones, tablet personal computers (PC), computers and televisions (TV), include display panels that display images. Such display panels may be implemented in various forms such as organic light-emitting diode (OLED) panels, active matrix organic light-emitting diode (AMOLED) panels, liquid crystal display (LCD) panels, electrophoretic display panels, electrowetting display panels, and plasma display panels (PDP). To drive the display panels, display driver devices are provided for display devices.

To ensure the reliability and the stability of the display driver devices, there are tests required for signal transmission characteristics, for whether the display driver devices normally operate, or for the quality of the display driver devices. However, the testing of the display driver devices does not include an individual test for each of the components (for example, a display driving chip) provided in the display driver devices.

SUMMARY

Embodiments of the inventive concept provide a display driver device capable of accessing a display driver integrated circuit in a test mode.

According to an embodiment of the inventive concept, a display driver device may include a timing controller, a display driver integrated circuit, a flexible printed circuit board, a connection line, and a test line.

The timing controller includes an output pad unit. The display driver integrated circuit includes an input pad unit. The display driver integrated circuit generates a data voltage based on image data and a control signal received from the timing controller. At least one of the timing controller and the display driver integrated circuit are mounted on the flexible printed circuit board.

The connection line and the test line are formed at the flexible printed circuit board. The connection line includes one end connected with the input pad unit and an opposite end connected with the output pad unit. The test line includes one end connected with the input pad unit and an opposite end which receives a test signal for testing the display driver integrated circuit.

The display driver device operates in the normal mode or the test mode. The display driver integrated circuit receives the image data through the connection line in the normal mode. The display driver integrated circuit receives the test signal through the test line in the test mode. The display driver integrated circuit is blocked from receiving the image data through the connection line when the display driver integrated circuit operates in the test mode.

The display driver integrated circuit may include an additional pad input unit that receives the test mode signal from an external source.

According to an embodiment of the inventive concept, the display driver integrated circuit may include a timing controller, a display driver integrated circuit, a connection line, and a test line.

The timing controller includes an output pad unit. The display driver integrated circuit includes an input pad unit and an internal line. The internal line is connected with an internal circuit which converts image data into a data voltage. The input pad unit includes a first input bump, a second input bump, and a switch unit.

The connection line includes one end connected with the input pad unit and an opposite end connected with the output pad unit. The one end of the connection line is connected with a driving input bump. The test line includes one end connected with the input pad unit and an opposite end which receives a test signal. The one end of the test line is connected with a test input bump.

The display driver integrated circuit operates in a normal mode or a test mode. The switch unit electrically connects the internal line with the driving input bump in the normal mode. The switch unit electrically connects the internal line with the test input bump in the test mode.

The display driver device may include a switch that electrically separates the test input bump from the driving input bump, and wherein in a timing controller test mode, a timing controller test signal input to the test input bump is provided to the timing controller via the driving input bump exclusive of the display driver integrated circuit.

According to an embodiment of the inventive concept, a display driver device includes a timing controller including an output pad unit; a display driver integrated circuit configured to operate in a normal mode or a test mode, the display driver having an input pad unit connected via a connection line with the output pad unit of the timing controller, the display driver integrated circuit configured to generate a data voltage based on image data received from the timing controller; a test line electrically connected at one end with the input pad unit of the display driver integrated circuit and an opposite end connected to a test pad unit to receive a test mode signal; wherein the display driver integrated circuit is configured to operate in the normal mode or in the test mode based on the test mode signal received through the test pad unit, and the timing controller blocks the display driver integrated circuit from receiving image data while in test mode.

The timing controller may include a test mode control unit that blocks the display driver integrated circuit from receiving image data while in test mode.

The display driver device may include a plurality of test lines and a plurality of connection lines, wherein the input pad unit of the display driver integrated circuit includes a plurality of test input pads and driving inputs pads, each of which is connected respectively to one of the test lines and the connection lines.

The test line is separate from the connection line, and the test mode signal is provided to the display driver integrated circuit directly from an external source to the display driver integrated circuit via the test pad unit and test line.

BRIEF DESCRIPTION OF THE DRAWINGS

The inventive concept will be better appreciated by a person of ordinary skill in the art from the following description with reference to the following figures, wherein like reference numerals refer to like parts throughout the various figures unless otherwise specified, and wherein.

DETAILED DESCRIPTION

In the following description, embodiments of the inventive concept will be described in detail to permit a person of ordinary skill in the art to practice the inventive concept.

Figure 1:
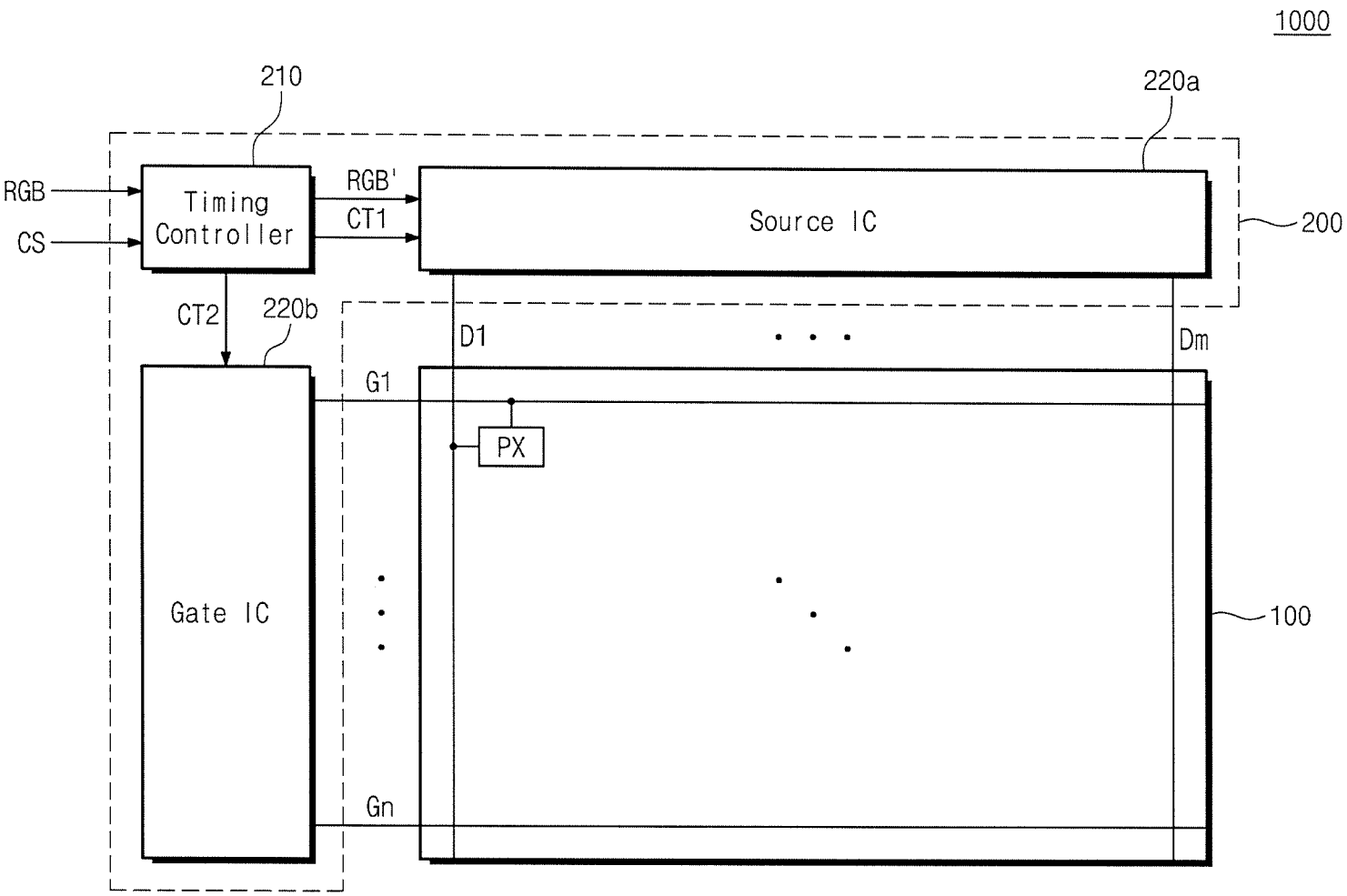
FIG. 1 is a block diagram illustrating a display device, according to an embodiment of the inventive concept.

FIG. 1 is a block diagram illustrating a display device 1000, according to an embodiment of the inventive concept.

The display device 1000 may include a display panel 100 and a display driver device 200. The display panel 100 displays an image thereon, and the display driver device 200 provides signals for displaying an image on the display panel 100.

The display panel 100 includes a plurality of gate lines G1 to Gn, a plurality of data lines D1 to Dm, and pixels PX. Each of the gate lines G1 to Gn receives a gate voltage from the display driver device 200. Each of the data lines D1 to Dm receives a data voltage from the display driver device 200. Each of the gate lines G1 to Gn is insulated from each of the data lines D1 to Dm, and each of the gate lines G1 to Gn crosses each of the data lines D1 to Dm. Each of the pixels PX may be connected with any one of the gate lines G1 to Gn and any one of the data lines D1 to Dm.

The display driver device 200 includes, for example, a timing controller 210, a source integrated circuit (IC) 220*a*, and a gate IC 220*b*.

The timing controller 210 receives image data RGB and a control signal CS from the outside. The control signal CS may include a vertical synchronization (sync) signal, which is a signal for frame identification, a horizontal synchronization (sync) signal, which is a signal for row identification, and a data enable signal having a high level for a data output duration to represent a section, in which data is input. The timing controller 210 outputs at least two control signals (e.g. a first control signal CT1, a second control signal CT2), and corrected image data RGB'. The timing controller 210 transforms a data format of the image data RGB based on an interface requirement of the source IC 220*a* to generate the corrected image data RGB' and provides the corrected image data RGB' to the source IC 220*a*. The first control signal CT1 comprises a signal for controlling the operation of the source IC 220*a*. The first control signal CT1 may include a horizontal start signal to start the operation of the source IC 220*a* and an output indication signal for determining a timing of outputting the data voltage from the source IC 220*a*. The second control signal CT2 is a signal to control an operation of the gate IC 220*b*. The second control signal CT2 may include, for example, a gate clock and a vertical start signal.

The source IC 220*a* outputs the data voltage to each of the data lines D1 to Dm based on the first control signal CT1 and the corrected image data RGB'. The source IC 220*a* performs a digital-analog conversion operation to convert the corrected image data RGB' into the data voltage.

The gate IC 220*b* provides a gate signal to the gate lines G1 to Gn based on the second control signal CT2. The gate IC 220*b* generates a gate signal for driving each of the gate lines G1 to Gn based on the second control signal CT2 and sequentially outputs the gate signal to each of the gate lines G1 to Gn.

Figure 2:
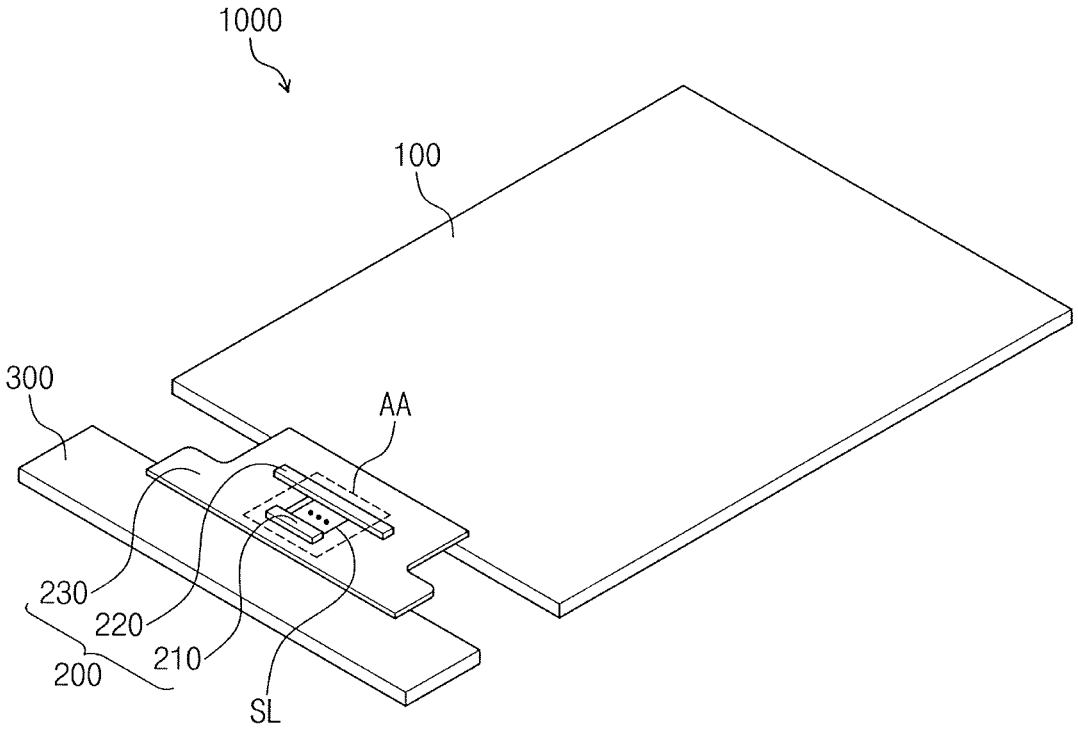
FIG. 2 is a perspective view illustrating a display device, according to an embodiment of the inventive concept.

FIG. 2 is a perspective view illustrating the display device 1000, according to an embodiment of the inventive concept.

Referring to FIG. 2, the display device 1000 may include the display panel 100, the display driver device 200, and a printed circuit board 300. For example, the printed circuit board may be a flexible printed circuit board.

The display panel 100 displays an image thereon. According to the inventive concept, the display panel 100 may be any one of various types of display panels. For example, the display panel 100 may be any one of, for example, an LCD panel, an OLED panel, an electrophoretic display panel, and an electrowetting display panel.

The display driver device 200 includes, for example, the timing controller 210, a display driver IC 220, and a flexible printed circuit board 230. The display driver IC 220 may correspond to the source IC 220*a* or the gate IC 220*b* of FIG. 1.

As shown in FIG. 2, the timing controller 210 and the display driver IC 220 may be mounted on the flexible printed circuit board 230. However, the inventive concept is not limited thereto. For example, the timing controller 210 or the display driver IC 220 may be mounted on the display panel 100 or may be mounted on the printed circuit board 300. The display driver device 200 receives the image data and the control signal which are used to drive the display panel 100, and provides a gate voltage and a data voltage to the display panel 100.

A part of the flexible printed circuit board 230 is attached to the display panel 100. Another part of the flexible printed circuit board 230 is attached to the printed circuit board 300. Although not shown in this embodiment of the inventive concept, there may be an intervening connection between the circuit boards. The flexible printed circuit board 230 may be formed therein with lines for providing image data, the control signal, power, and the like to the display panel 100, the timing controller 210, and the display driver IC 220.

A connection line SL may be formed at the flexible printed circuit board 230 such that the connection line SL electrically connects the timing controller 210 with the display driver IC 220. In a case where the timing controller 210 and the display driver IC 220 are mounted on the flexible printed circuit board 230, the connection line SL may be formed within the flexible printed circuit board 230 such that the connection line SL is prevented from being exposed to the outside. In this case, the connection line SL may be prevented, for example, from being exposed to static electricity, which may affect the robustness of the connection line SL. Accordingly, in the timing controller 210 or the display driver IC 220, a diode or a resistor may not be additionally provided to form a path of discharging static electricity. Such a construction may result in pad units provided in the timing controller 210 or the display driver IC 220 having a reduction in size.

With continued reference to FIG. 2, the printed circuit board 300 is attached to the flexible printed circuit board 230. The printed circuit board 300 may have mounted thereon with a processor and a power supply unit which are used to provide image data.

Figure 3:
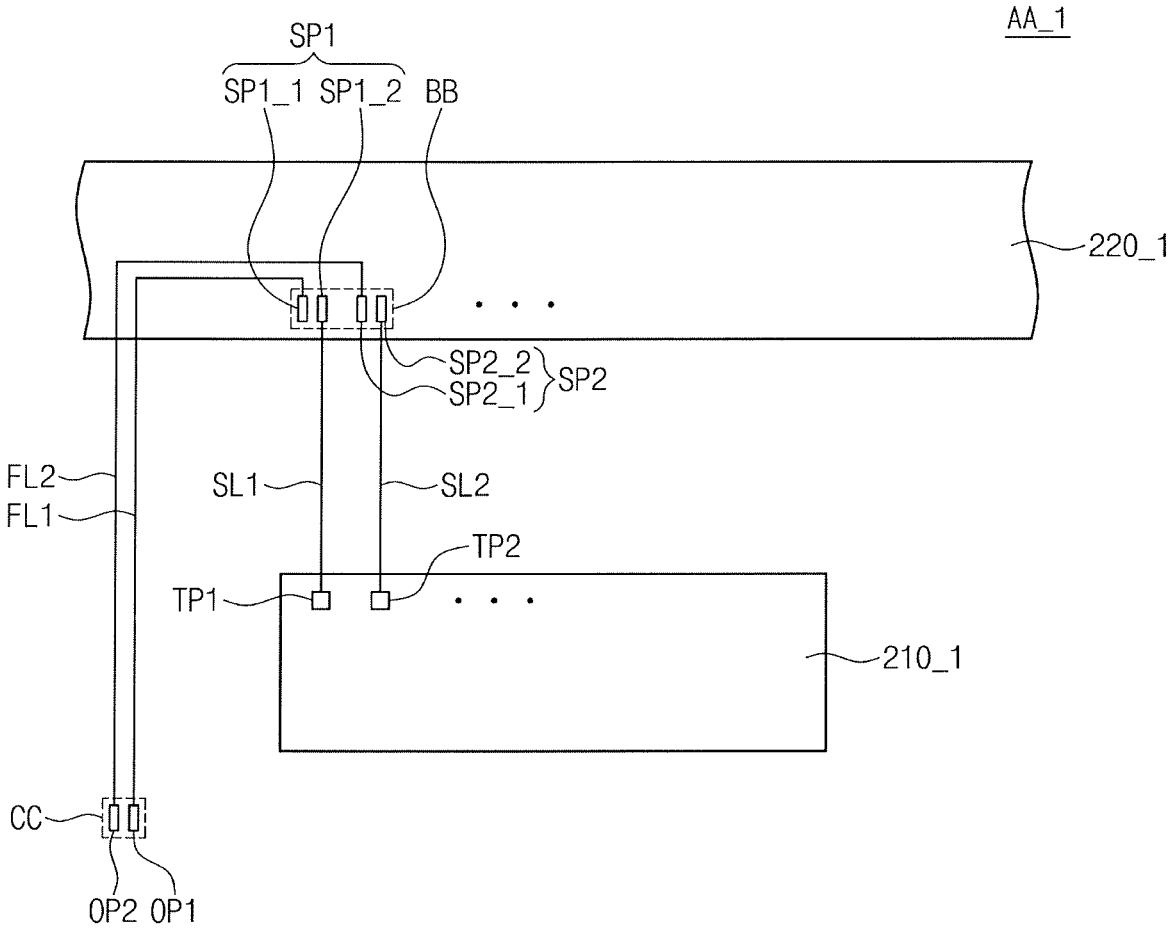
FIG. 3 is a plan view illustrating a display driver device of FIG. 2, according to an embodiment of the inventive concept.

FIG. 3 is an enlarged view illustrating a part AA_1 of the display driver device of FIG. 2, according to an embodiment of the inventive concept.

Referring to FIG. 3, the display driver device 200 may include a timing controller 210_1, a display driver IC 220_1, first and second connection lines SL1 and SL2, first and second test lines FL1 and FL2, and first and second test pad units OP1 and OP2.

As shown in FIG. 3, the timing controller 210_1 includes a first output pad unit TP1 and a second output pad unit TP2. However, a person or ordinary skill in the art should understand that although the timing controller 210_1 of FIG. 3 includes two output pad units for illustrative purposes, the number of output pad units is not limited in the timing controller 210_1. The first output pad unit TP1 is electrically connected with the first connection line SL1. The second output pad unit TP2 is electrically connected with the second connection line SL2.

The display driver IC 220_1 includes the first input pad unit SP1 and the second input pad unit SP2, and a person of ordinary skill in the art should understand that the number of input pad units is not limited to the quantity shown in the display driver IC 220_1 of FIG. 3. The first input pad unit SP1 may include a first test input pad unit SP1_1 and a first driving input pad unit SP1_2. The second input pad unit SP2 may include a second test input pad unit SP2_1 and a second driving input pad unit SP2_2. The first test input pad unit SP1_1 is electrically connected with the first test line FL1. The first driving input pad unit SP1_2 is electrically connected with the first connection line SL1. The second test input pad unit SP2_1 is electrically connected with the second test line FL2. The second driving input pad unit SP2_2 is electrically connected with the second connection line SL2. The first test input pad unit SP1_1 and the first driving input pad unit SP1_2 are spaced apart from each other. The second test input pad unit SP2_1 and the second driving input pad unit SP2_2 are spaced apart from each other.

The first and second test lines FL1 and FL2 are formed at the flexible printed circuit board 230. The first and second test lines FL1 and FL2 may be formed within the flexible printed circuit board 230 and thus may be prevented from being exposed to external stresses. Alternatively, the first and second test lines FL1 and FL2 may be printed on the flexible printed circuit board 230. One end of the first test line FL1 is connected with the first test input pad unit SP1_1, and an opposite end of the first test line FL1 is connected with the first test pad unit OP1. One end of the second test line FL2 is connected with the second test input pad unit SP2_1, and an opposite end of the second test line FL2 is connected with the second test pad unit OP2. The first test line FL1 and the second test line FL2 may be used to provide test signals to the display driver IC 220_1.

Since the display driver IC 220_1 receives the test signals through the first and second test lines FL1 and FL2, the construction in this example permits that the test signals may be directly applied to the display driver IC 220_1 without passing through the timing controller 210_1.

More particularly, as described with reference to FIG. 2, when the connection line SL is not exposed to the outside (e.g. the connection line may be formed within the printed circuit board), the ability to perform a test through the connection line SL may present challenges to perform testing that may not be present with a different arrangement of the connection line SL. Accordingly, the display driver device 200 may further include the first and second test lines FL1 and FL2 to test the quality of the display driver IC 220_1 or the operation of the display driver IC 220_1. In addition, the test signals are directly applied to the display driver IC 220_1 through the first and second test lines FL1 and FL2, the test time may be reduced as compared with a test time in which the test signals are applied to the display driver IC 220_1 through the timing controller 210_1.

The first test pad unit OP1 and the second test pad unit OP2 may make contact with a probe of a test device for the test of the display driver IC 220_1. The first test pad unit OP1 and the second test pad unit OP2 may be floated (e.g. no connection to a voltage or to ground) when the display driver IC 220_1 operates in a normal mode.

The display driver device 200 operates in a normal mode or in a test mode. In the normal mode, the display driver device 200 receives image data for displaying an image on the display panel 100 and provides the data voltage to the display panel 100. In the test mode, the display driver device 200 receives a test signal and the quality of the display driver IC 220_1 is tested based on the test signal.

In the normal mode, the timing controller 210_1 provides the image data or the control signal to the first driving input pad unit SP1_2 and the second driving input pad unit SP2_2 through the first and second connection lines SL1 and SL2. In this case, the first test input pad unit SP1_1 and the second test input pad unit SP2_1 are controlled so as to be prevented from receiving the test signals.

In the test mode, the first test input pad unit SP1_1 and the second test input pad unit SP2_1 receive the test signals, and the first driving input pad unit SP1_2 and the second driving input pad unit SP2_2 are controlled to be prevented from receiving the image data and the control signal from the timing controller 210_1.

The normal mode of operation and the test mode of operation are determined based on a mode control signal provided to the display driver IC 220_1. In other words, the display driver IC 220_1 determines, based on the mode control signal, whether the display driver IC 220_1 receives the test signals through the first test input pad unit SP1_1 and the second test input pad unit SP2_1, or whether the display driver IC 220_1 receives the image data or the control signal through the first driving input pad unit SP1_2 and the second driving input pad unit SP22.

For example, the mode control signal may include a test mode signal. The display driver IC 220_1 operates in the test mode in this example when the display driver IC 220_1 receives the test mode signal, and operates in the normal mode when the display driver IC 220_1 does not receive the test mode signal.

FIGS. 4 to 7 are enlarged views illustrating a region BB_1, BB_2, BB_3, and BB_4 of FIG. 3 to explain the structures of the first and second input pad units SP1 and SP2, according to various embodiments of the inventive concept.

Figure 4:
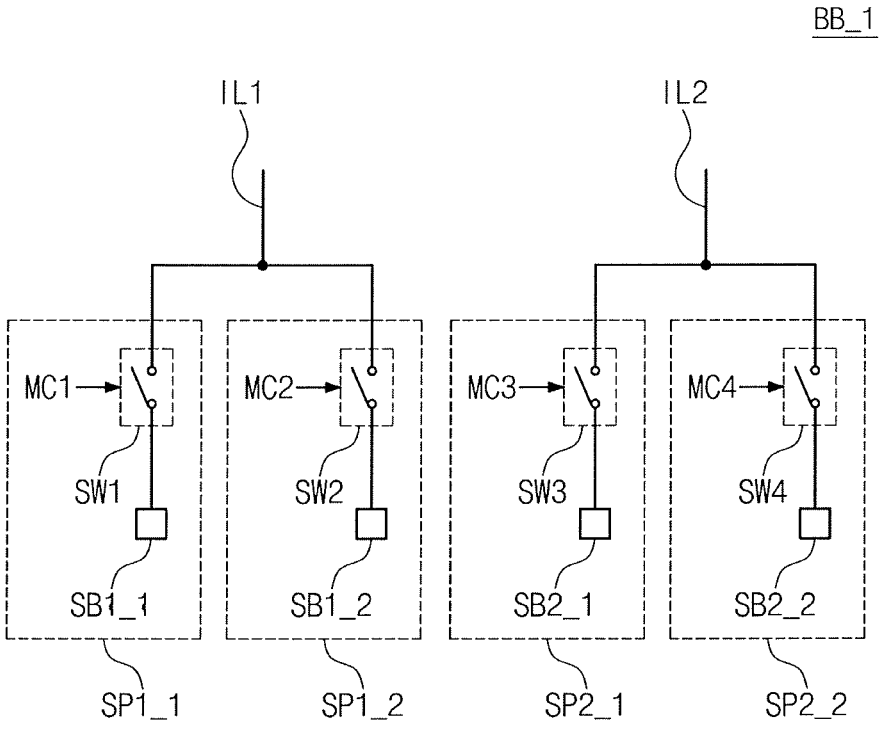
FIGS. 4 to 7 are views illustrating the structures of first and second input pad units.

Referring to FIG. 4, the first test input pad unit SP1_1 includes a first test input bump SB1_1 and a first switch SW1. The first driving input pad unit SP1_2 includes a first driving input bump SB1_2 and a second switch SW2. The second test input pad unit SP2_1 includes a second test input bump SB2_1 and a third switch SW3. The second driving input pad unit SP2_2 includes a second driving input bump SB2_2 and a fourth switch SW4.

The first test input bump SB1_1 is connected with the first test line FL1. The first driving input bump SB1_2 is connected with the first connection line SL1. The second test input bump SB2_1 is connected with the second test line FL2. The second driving input bump SB2_2 is connected with the second connection line SL2.

With continued reference to FIG. 4, one end of the first switch SW1 is connected with the first test input bump SB1_1, and an opposite end of the first switch SW1 is connected with a first internal line IL1 connected with an internal circuit (not illustrated) of the display driver IC 220_1. One end of the second switch SW2 is connected with the first driving input bump SB1_2, and an opposite end of the second switch SW2 is connected with the first internal line IL1 and the opposite end of the first switch SW1. One end of the third switch SW3 is connected with the second test input bump SB2_1, and an opposite end of the third switch SW3 is connected with a second internal line IL2 connected with the internal circuit of the display driver IC 220_1. One end of the fourth switch SW4 is connected with the second driving input bump SB2_2, and an opposite end of the fourth switch SW4 is connected with the second internal line IL2 and the opposite end of the third switch SW3.

The on/off states of the first, second, third and fourth switches SW1, SW2, SW3 and SW4 may be determined based on the test mode signal. For example, each of the first, second, third and fourth switches SW1, SW2, SW3 and SW4 may be a transistor, and the test mode control signal may be applied to a control terminal of each of the first to fourth switches SW1 to SW4. The test mode signal may include first, second, third and fourth switch control signals MC1, MC2, MC3 and MC4 to determine the on/off states of the first to fourth switches SW1 to SW4, respectively. The test mode signal may be provided to the display driver IC 220_1 from an external test device, and the display driver IC 220_1 may include an additional pad unit which is used to receive the test mode signal.

In the normal mode, the first switch SW1 and the third switch SW3 are switched off, and the second switch SW2 and the fourth switch SW4 are switched on, so that driving input signals are provided to IL1 and IL2, respectively. For example, the first switch control signal MC1 and the third switch control signal MC3 may be at a low level, and the second switch control signal MC2 and the fourth switch control signal MC4 may be at a high level. The first driving input pad unit SP1_2 and the second driving input pad unit SP2_2 are electrically connected with the first internal line IL1 and the second internal line IL2, respectively through the respective switches SW2 and SW4. The first test input pad unit SP1_1 and the second test input pad unit SP2_1 are electrically disconnected from the internal circuit of the display driver IC 220_1 as switches SW1 and SW3 received a respective low level of control signals MC1 and MC3. Accordingly, the display driver IC 220_1 may receive data from the timing controller 210_1.

In the test mode, the first switch SW1 and the third switch SW3 are switched on, and the second SW2 and the fourth switch SW4 are switched off. For example, the first switch control signal MC1 and the third switch control signal MC3 may be at the high level, and the second switch control signal MC2 and the fourth switch control signal MC4 may be at the low level. In this case, the first driving input pad unit SP1_2 and the second driving input pad unit SP2_2 are electrically disconnected from the internal circuit of the display driving circuit 220_1. The first test input pad unit SP1_1 and the second test input pad unit SP2_1 are electrically connected with the first internal line IL1 and the second internal line IL2, respectively. Accordingly, the display driver IC 220_1 may not receive data from the timing controller 210_1 (see FIG. 3). The display driver IC 220_1 receives the test signals from the first test line FL1 and the second test line FL2. The test signals are not provided from the display driver IC 220_1 to the timing controller 210_1, but are provided to the internal circuit. In other words, the operating characteristic and the quality of the display driver IC 220_1 may be exactly tested, and the self-defect, such as disconnection, of the display driver IC 220_1, may be easily checked.

When the first, second, third and fourth switches SW1, SW2, SW3 and SW4 are switched on, the operating characteristic and the quality of the display driver device 200 including the timing controller 210_1 and the display driver IC 220_1 may be additionally tested. When the first to fourth switches SW1 to SW4 are switched on, the contact failure or the disconnection of the first and second connection lines SL1 and SL2 may be checked.

Figure 5:
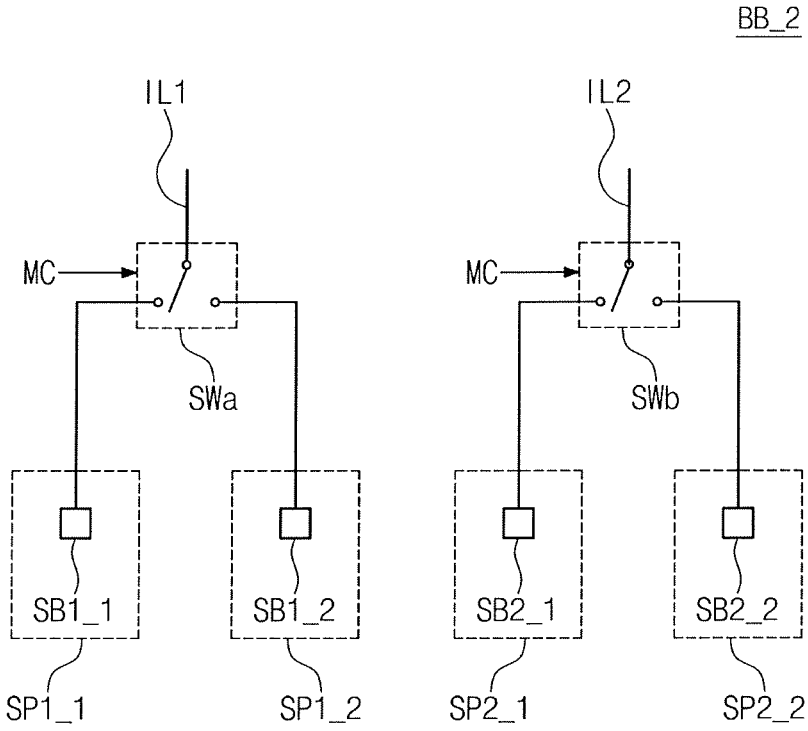

Referring now to FIG. 5, a first test input pad unit SP1_1 includes the first test input bump SB1_1, and a first driving input pad unit SP1_2 includes the first driving input bump SB1_2. A second test input pad unit SP2_1 includes the second test input bump SB2_1, and a second driving input pad unit SP2_2 includes the second driving input bump SB2_2. The input pad unit of the display driver IC 220_1 includes a first mode selection switch SWa and a second mode selection switch SWb. The first test input bump SB1_1, the first driving input bump SB1_2, the second test input bump SB2_1, and the second driving input bump SB2_2 have the substantially same configurations as those of the first test input bump SB1_1, the first driving input bump SB1_2, the second test input bump SB2_1, and the second driving input bump SB2_2 of FIG. 4, respectively, and perform the substantially same functions as those of the first test input bump SB1_1, the first driving input bump SB1_2, the second test input bump SB2_1, and the second driving input bump SB2_2 of FIG. 4, respectively.

With continued reference to FIG. 5, the first mode selection switch SWa is connected with the first internal line IL1, and is selectively connected with any one of the first test input bump SB1_1 and the first driving input bump SB1_2 based on a mode control signal MC. In the normal mode, the first mode selection switch SWa electrically connects the first driving input bump SB1_2 with the first internal line IL1 such that the display driver IC 220_1 may receive data from the timing controller 210_1. In the test mode, the first mode selection switch SWa electrically connects the first test input bump SB1_1 with the first internal line IL1 such that the display driver IC 220_1 receives a test signal through the test line FL1. The second mode selection switch SWb is connected with the second internal line IL2, and is selectively connected with any one of the second test input bump SB2_1 and the second driving input bump SB2_2. In the normal mode, the second mode selection switch SWb electrically connects the second driving input bump SB2_2 with the second internal line IL2. In the test mode, the second mode selection switch SWb electrically connects the second test input bump SB2_1 with the second internal line IL2.

Figure 6:
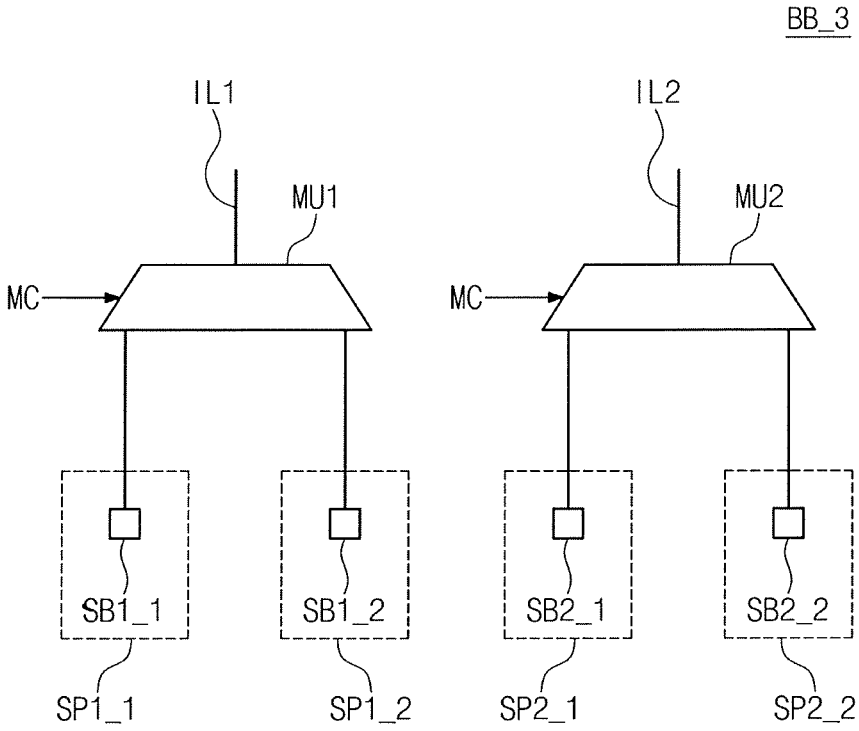

Referring to FIG. 6, the input pad units of the display driver IC 220_1 includes a first multiplexer MU1 and a second multiplexer MU2 instead of the arrangement of the first mode selection switch SWa and the second mode selection switch SWb of FIG. 5. Input terminals of the first multiplexer MU1 are electrically connected with a first test input bump SB1_1 and a first driving input bump SB1_2. An output terminal of the first multiplexer MU1 is electrically connected with a first internal line IL1. The first multiplexer MU1 receives a test signal from the first test input bump SB1_1 and provides the test signal to the first internal line IL1, in the test mode based on a mode control signal MC. The first multiplexer MU1 receives data from a first driving input bump SB1_2 and provides the data to the first internal line IL1, in the normal mode based on the mode control signal MC. Input terminals of the second multiplexer MU2 are electrically connected with a second test input bump SB2_1 and a second driving input bump SB2_2. An output terminal of the second multiplexer MU2 is electrically connected with a second internal line IL2. The second multiplexer MU2 receives the test signal from the second test input bump SB2_1 in the test mode based on the mode control signal MC. The second multiplexer MU2 receives data from the second driving input bump SB2_2 in the normal mode based on the mode control signal MC.

Figure 7:
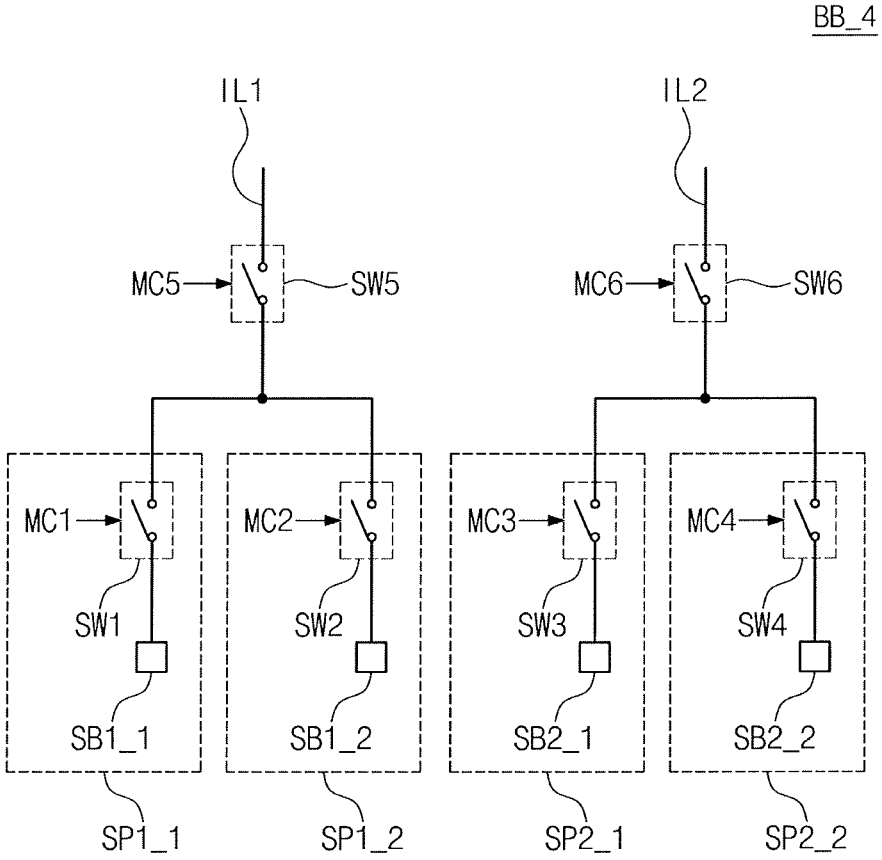

Referring to FIG. 7, the arrangement of first and second input pad units of a display driver IC 220_1 further include a fifth switch SW5 and a sixth switch SW6 in addition to the configuration of the first and second input pad units of FIG. 4. One end of the fifth switch SW5 is connected with the opposite end of the first switch SW1 and the opposite end of the second switch SW2. An opposite end of the fifth switch SW5 is connected with a first internal line IL1. In addition, one end of the sixth switch SW6 is connected with the opposite end of the third switch SW3 and the opposite end of the fourth switch SW4. An opposite end of the sixth switch SW6 is connected with a second internal line IL2. The on/off state of the fifth switch SW5 may be determined based on a fifth switch control signal MC5. The on/off state of the sixth switch SW6 may be determined based on a sixth switch control signal MC6.

The operations of the first, second, third and fourth switches SW1, SW2, SW3 and SW4 in the normal mode and the test mode are the same as those of FIG. 4. In the normal mode and test mode, the fifth switch SW5 and the sixth switch SW6 are switched on. A display driver device 200 may have a timing controller test mode in addition to the normal mode and test mode. For example, in the timing controller test mode, a test signal is provided to the timing controller 210_1, and is not provided to the internal circuit of a display driver IC 220_1.

In detail, the fifth and sixth switches SW5 and SW6 shown in FIG. 7 are switched off in the timing controller test mode. For example, the fifth and sixth switch control signals MC5 and MC6 may be at a low level. In this case, a test signal, which is provided to the first test input bump SB1_1, is provided to the timing controller 210_1 through the first driving input bump SB1_2. A test signal, which is provided to the second test input bump SB2_1, is provided to the timing controller 210_1 through the second driving input bump SB2_2. In other words, the operating characteristic and the quality of the timing controller 210_1 may be exactly tested. Alternatively, a switch may electrically separate a path from the test input bump to the driving input bump, and wherein in a timing controller test mode, a timing controller test signal input to the test input bump is provided to the timing controller via the driving input bump exclusive of the display driver integrated circuit.

Figure 8:
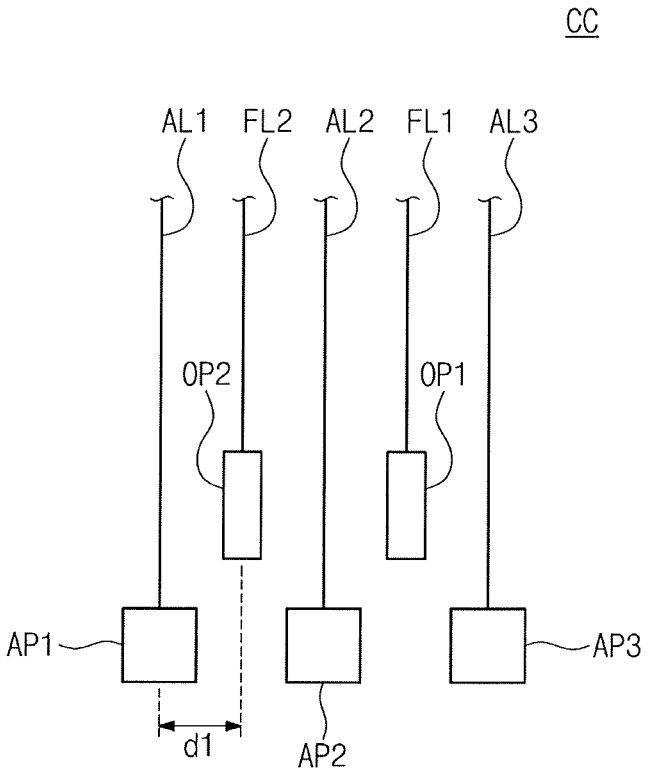
FIG. 8 is an enlarged view illustrating the structures of first and second test pad units, according to an embodiment of the inventive concept.

FIG. 8 is an enlarged view illustrating the region CC of FIG. 3 to assist with an explanation of the structures of the first and second test pad units OP1 and OP2, according to an embodiment the inventive concept.

Referring to FIG. 8, the display driver device 200 further includes first to third lines AL1, AL2, and AL3 and first to third pad units AP1, AP2 and AP3. The first to third pad units AP1 to AP3 are connected to the printed circuit board 300. For example, the first to third pad units AP1 to AP3 may receive a supply voltage from the printed circuit board 300. The first to third lines AL1 to AL3 are formed at the flexible printed circuit board 230. One end of the first to third lines AL1 to AL3 are connected, respectively, to the first to third pad units API to AP3. Opposite ends of the first to third lines AL1 to AL3 are electrically connected with the internal circuit of the display driver IC 220_1, respectively. For example, the supply voltage received from the printed circuit board 300 may be provided through the first to third lines AL1 to AL3 to the internal circuit of the display driver IC 220_1. The display driver IC 220_1 may further include pad units in contact with the opposite ends of the first to third lines AL1 to AL3.

The arrangement direction of the first to third pad units AP1, AP2 and AP3 may be the same as that of the first and second test pad units OP1 and OP2. The first to third pad units AP1 to AP3 and the first and second test pad units OP1 and OP2 may be arranged in a staggered form. For example, the direction that the first and second pad units AP1 and AP2 are adjacent to each other may form a predetermined angle about the direction that the first pad unit AP1 and the second pad unit OP2 are adjacent to each other. The second test pad unit OP2 may be interposed between the first line AL1 and the second line AL2. The first test pad unit OP1 may be interposed between the second line AL2 and the third line AL3. The first pad unit AP1 and the second pad unit OP2 are spaced apart from each other by a first width dl in the direction that the first to third pad units AP1 to AP3 are arranged. The first to third pad units AP1 to AP3 and the first and second test pad units OP1 and OP2 are arranged in the staggered form, thereby minimizing the size of the first width d1. In other words, the structure of FIG. 8 may minimize the area of the flexible printed circuit board 230. In addition, the first to third pad units AP1 to AP3 may be larger than the first and second test pad units OP1 and OP2 in area. Although FIG. 8 illustrates that the difference in distances between the first and second test pad units OP1 and OP2 and the display driver IC 220_1 are shorter than the difference in distances between the first to third pad units AP1 to AP3 and the display driver IC 220_1, the inventive concept is not limited thereto. For example, the distance differences between the first and second test pad units OP1 and OP2 and the display driver IC 220_1 may be longer than the distance differences between the first to third pad units AP1 to AP3 and the display driver IC 220_1.

Figure 9:
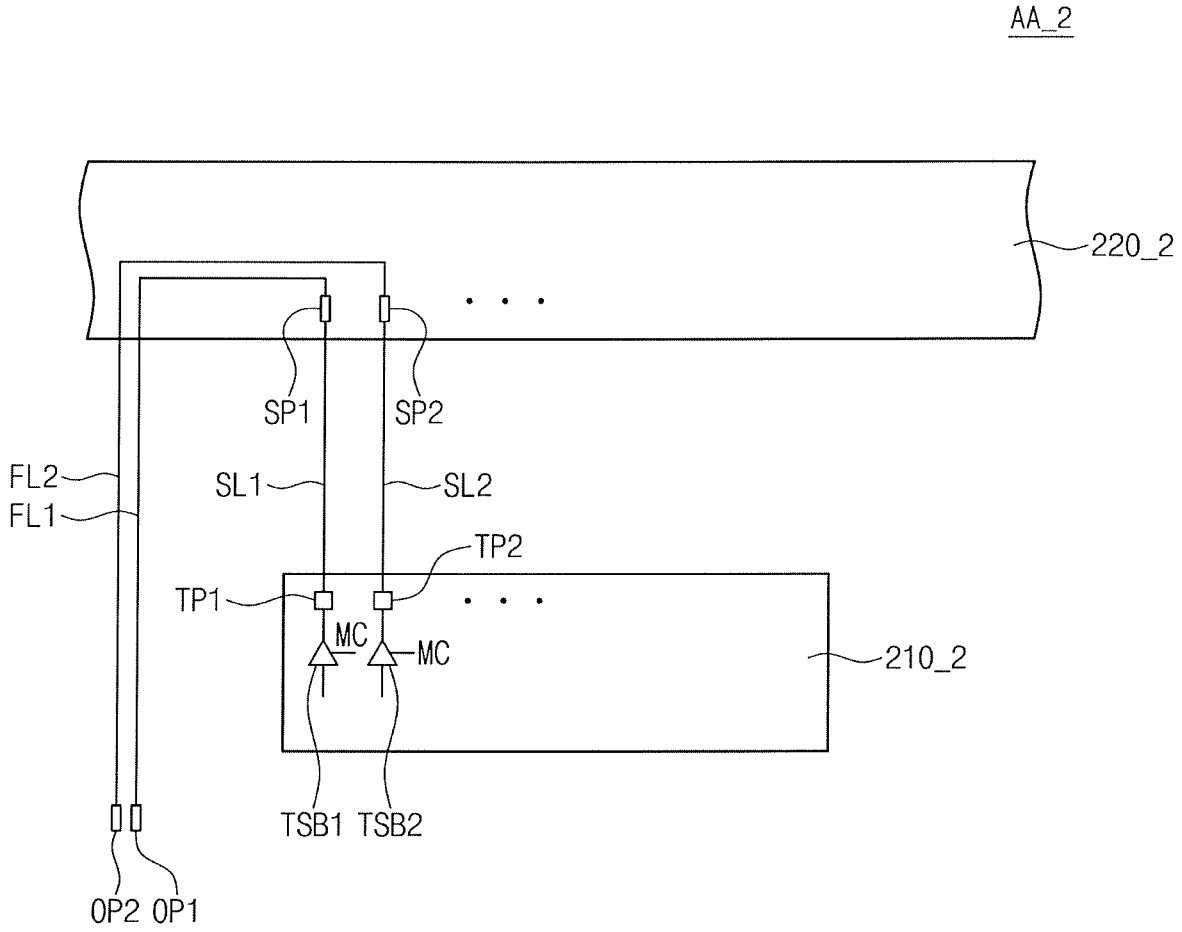
FIG. 9 is a plan view illustrating a display driver device of FIG. 2, according to an embodiment of the inventive concept.

FIG. 9 is an enlarged plan view illustrating the region AA_2 of the display driver device of FIG. 2, according to another embodiment of the inventive concept.

Referring to FIG. 9, the display driver device 200 includes a timing controller 210_2, a display driver IC 220_2, first and second connection lines SL1 and SL2, first and second test lines FL1 and FL2, and first and second test pad units OP1 and OP2. Although two connection lines (SL1 and SL2)

and two test lines (FL1 and FL2) are shown, and a person of ordinary skill in the art should understand and appreciate that larger quantities of the connection lines and test lines may be provided. In addition, the number of test lines may not be equal to the number of connection lines.

The timing controller 210_2 shown in FIG. 9 includes a first output pad unit TP1, a second output pad unit TP2, a first tri-state buffer TSB1, and a second tri-state buffer TSB2. The first output pad unit TP1 is electrically connected with the first connection line SL1. The second output pad unit TP2 is electrically connected with the second connection line SL2.

Each of the first tri-state buffer TSB1 and the second tri-state buffer TSB2 includes an input terminal, an output terminal, and a control terminal. For example, the respective Mode Control (MC) lines may be connected to a respective control terminal of TSB1 or TSB2. The image data or the control signal is received through the input terminal, and is output through the output terminal to a respective output pad TP1 or TP2. The control terminal is used to determine whether the image data or the control signal received through the input terminal is output. The control terminal is used to receive a mode control signal.

For example, when a mode control signal at a lower level is applied to the control terminal, the first tri-state buffer TSB1 or the second tri-state buffer TSB2 may block a signal that is received through the input terminal, from being output through the output terminal. A tri-state buffer, for example, has a third state with a high impedance rate (High-Z) in addition to low logic (0) and high logic (1) levels. At the high impedance rate the output of the buffer can be essentially electrically disconnected from the rest of the circuit. When the mode control signal at a high level is applied to the control terminal, the first tri-state buffer TSB1 or the second tri-state buffer TSB2 may output the signal received through the input terminal.

The display driver IC 220_2 includes the first input pad unit SP1 and the second input pad unit SP2. The first input pad unit SP1 shown in FIG. 9 may not be divided into the first test input pad unit SP1_1 and the first driving input pad unit SP1_2, which is different from the configuration shown in FIG. 3. The first input pad unit SP1 is connected with the first test line FL1, and the second input pad unit SP2 is connected with the second test line FL2. Accordingly, the first input pad unit SP1 and the second input pad unit SP2 may receive test signals. The first input pad unit SP1 is connected with the first connection line SL1, and the second input pad unit SP2 is connected with the second connection line SL2. Accordingly, the first input pad unit SP1 and the second input pad unit SP2 may receive image data or a control signal.

With reference to FIG. 9, the display driver IC 220_2 operates in a normal mode or in a test mode. In the normal mode, the first tri-state buffer TSB1 and the second tri-state buffer TSB2 provide signals that are applied to the relevant input terminals thereof, to the relevant output terminals thereof. Accordingly, the display driver IC 220_2 may receive the image data or the control signal. In addition, in the test mode the first tri-state buffer TSB1 and the second tri-state buffer TSB2 block the signals to the timing controller 210_2, which are applied to the relevant input terminals thereof. In other words, in the test mode, the display driver IC 220_2 receives a test signal provided from each of the first and second test lines FL1 and FL2, and the quality of the display driver IC 220_2 is tested based on the test signal. Since the signals of the first tri-state buffer TSB1 and the second tri-state buffer TSB2 are blocked from being provided, the test signals are not provided to the timing controller 210_2 through the first and second connection lines SL1 and SL2.

Accordingly, the operating characteristic and the quality of the display driver IC 220_2 may be exactly (e.g. directly) tested without the timing controller having an effect on the display driver IC 220_2 being tested, because the test signals may be provided directly from an external testing source to the display driver IC without being routed through another component such as the timing controller. Accordingly, a self-defect, of the display driver IC 220_1, such as a disconnection, may be easily checked without determining whether another component may have caused the disconnection instead of the display driver IC 220_2. According to the inventive concept, the testing may be more exact (e.g. may be directed to a specific component).

The display driver IC 220_2 may operate in the normal mode or in the test mode depending on the mode control signal MC applied to the control terminal of each of the first tri-state buffer TSB1 and the second tri-state buffer TSB2. The mode control signal MC may include a test mode signal. When the test mode signal is applied to each of the first tri-state buffer TSB1 and the second tri-state buffer TSB2, the first tri-state buffer TSB1 and the second tri-state buffer TSB2 block the outputs from the relevant output terminals. The control terminal of each of the first tri-state buffer TSB1 and the second tri-state buffer TSB2 receives the same mode control signal MC, and thus the modes of the first and second tri-state buffer TSB1 and TSB2 may be simultaneously determined. The mode control signal MC may be provided to the timing controller 210_2 from an external test device, and the timing controller 210_2 may include additional pad units used to receive the mode control signal MC. The additional pad units may be connected, for example, with the control terminals of the first tri-state buffer TSB1 and the second tri-state buffer TSB2, respectively.

Figure 10:
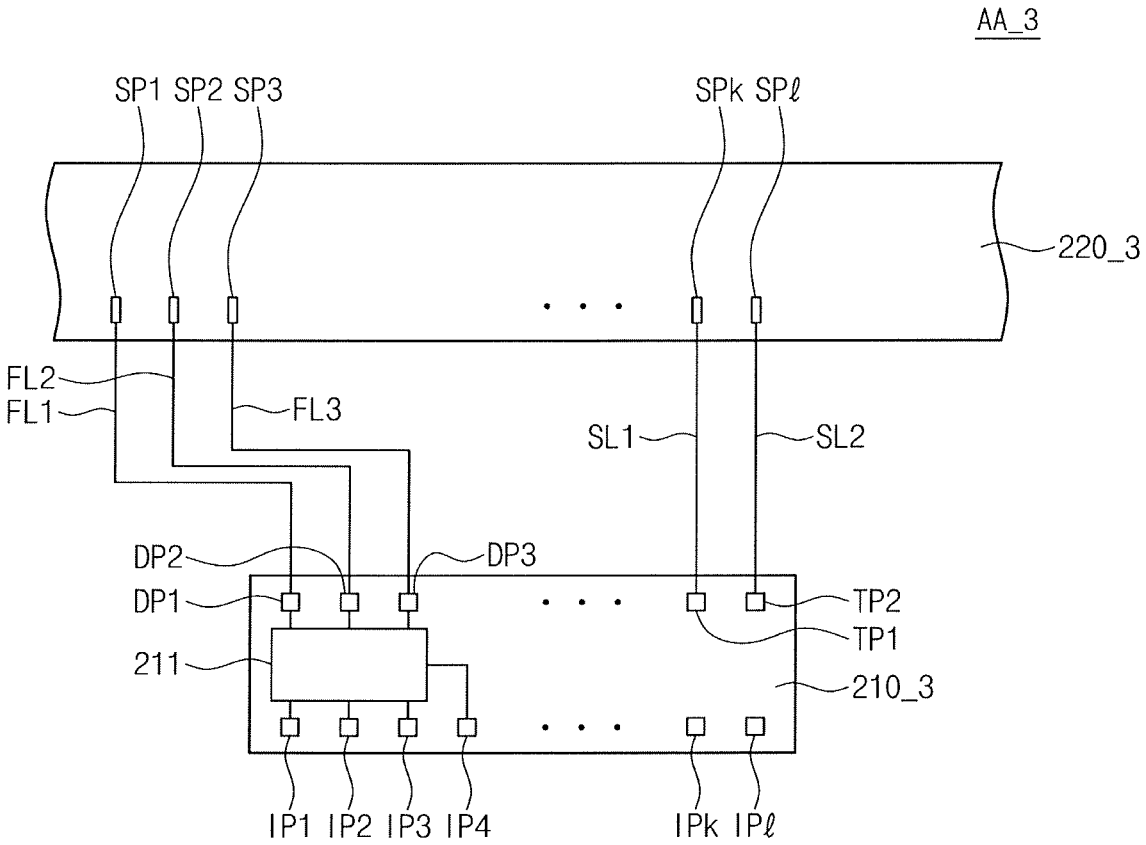
FIG. 10 is a plan view illustrating a display driver device of FIG. 2, according to an embodiment of the inventive concept.

FIG. 10 is an enlarged plan view illustrating the region AA_3 of the display driver device of FIG. 2, according to another embodiment of the inventive concept.

Referring to FIG. 10, the display driver device 200 may include a timing controller 210_3, a display driver IC 220_3, first to third test lines FL1 to FL3, and first and second connection lines SL1 and SL2. The display driver device 200 of FIG. 10 may not include an additional test pad unit, which is different from the configuration of FIG. 3 or FIG. 9. In other words, the display driver device of FIG. 10 may test the display driver IC 220_3 by connecting the first, second and third test lines FL1, FL2 and FL3 with the timing controller 210_3.

The timing controller 210_3 includes first to $l^{th}$ receive pad units IP1, IP2, IP3, IP4 . . . , IPk, and IPl, first, second and third dummy pad units DP1, DP2 and DP3, first to second output pad units TP1 and TP2, and a test mode control unit 211. The first to $l^{th}$ receive pad units IP1 to IPl receive the image data, the control signal, or test signals. The first to fourth receive pad units IP1 to IP4 are electrically connected with the test mode control unit 211. However, the embodiment in FIG. 10 is not limited to the configuration shown. For example, some of the first to $l^{th}$ receive pad units IP1 to IPl are electrically connected with the test mode control unit 211. The first and second output pad units TP1 and TP2 are electrically connected with the first and second connection lines SL1 and SL2, respectively. The first to third dummy pad units DP1 to DP3 are electrically connected with the test mode control unit 211. The first to third dummy pad units DP1 to DP3 are electrically connected with the first to third test lines FL1 to FL3.

Although the first to fourth receive pad units IP1 to IP4 and the first to third dummy pad units DP1 to DP3 may not be used in the normal mode, the embodiment in FIG. 10 is not limited to the configuration shown. For example, the first to fourth receive pad units IP1 to IP4 and the first to third dummy pad units DP1 to DP3 may receive or output the test signals in the test mode, or may receive or output the image data or the control signal when in the normal mode.

The test mode control unit 211 determines an operating mode of the display driver IC 220_3. For example, when the display driver IC 220_3 operates in the test mode, the test mode control unit 211 performs a control operation such that the test signal is provided to the display driver IC 220_3. In the test mode, the first to third receive pad units IP1 to IP3 provide the test signals to the first to third dummy pad units DP1 to DP3, respectively. In the normal mode, the test mode control unit 211 prevents (e.g. blocks) the test signals from being provided to the first to third dummy pad units DP1 to DP3. The fourth receive pad unit IP4 may receive a test mode signal for the test mode and the operation of the test mode control unit 211 may be controlled, which will be more fully described later.

The display driver IC 220_3 includes input first to $l^{th}$ input pad units SP1, SP2, SP3, . . . SPk, and SPl. The first to third input pad units SP1 to SP3 may receive the test signals in the test mode. The number of the input pad units, which receive the test signals, may correspond to the number of output pad units connected with the test mode control unit 211.

The first to third test lines FL1 to FL3 electrically connect the dummy pad units DP1 to DP3 with the first to third input pad units SP1 to SP3. In the test mode, the first to third test lines FL1 to FL3 may perform the substantially the same functions as those of the first and second test lines FL1 and FL2 of FIG. 3 or FIG. 9. Since the display driver IC 220_3 may be tested by using the first to third test lines FL1 to FL3 connected with the timing controller 210_3, the flexible printed circuit board 230 may be prevented from being enlarged due to the arrangement of additional lines and additional pad units.

Figure 11:
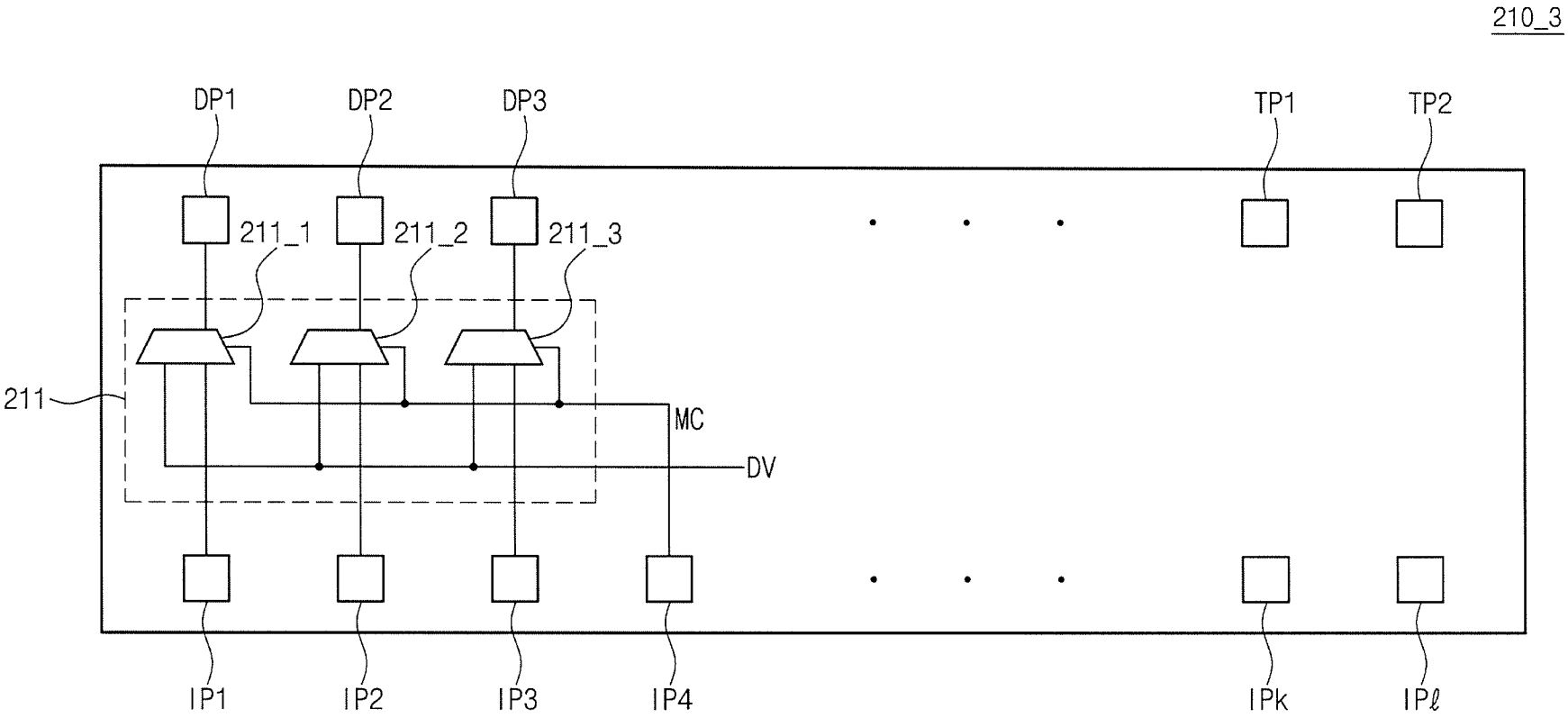
FIG. 11 is a detailed view illustrating a timing controller of FIG. 10.

FIG. 11 is a view illustrating the timing controller 210_3 of FIG. 10.

Referring to FIG. 11, the test mode control unit 211 includes a first multiplexer 211_1, a second multiplexer 211_2, and a third multiplexer 211_3. The number of multiplexers included in the test mode control unit 211 may correspond to the number of dummy pad units connected with the test mode control unit 211. Each of the first to third multiplexers 211_1 to 211_3 may include at least two input terminals (IP), a control terminal (MC), and an output terminal. As shown in FIG. 11, among the at least two input terminals of each of the first to third multiplexers 211_1 to 211_3, one input terminal is electrically connected with a first, second, or third receive pad unit IP1, IP2, or IP3, respectively, to receive the test signal, and a different input terminal receives a default value (DV). The control terminal of each of the first to third multiplexers 211_1 to 211_3 is electrically connected with the fourth receive pad unit IP4 to receive the mode control signal MC. The mode control signal MC includes a test mode signal. When the test mode signal is provided to the control terminal of each of the first to third multiplexers 211_1 to 211_3, the first to third multiplexer 211_1 to 211_3 output the test signals, which are received from the first to third receive pad units IP1 to IP3, to respective output terminals thereof. When the test mode signal (of the mode control signal MC) is not provided to the control terminals of the first to third multiplexers 211_1 to 211_3, the first to third multiplexers 211_1 to 211_3 output the DV. The DV may be zero.

The output terminals of the first to third multiplexers 211_1 to 211_3 are electrically connected with the first to third dummy pad units DP1 to DP3, respectively. The first to third dummy pad units DP1 to DP3 may receive the test signals or the DV from the first to third multiplexers 211_1 to 211_3. In other words, the test mode control unit 211 determines, based on the mode control signal MC, whether the display driver IC 220_3 is tested.

Figure 12:
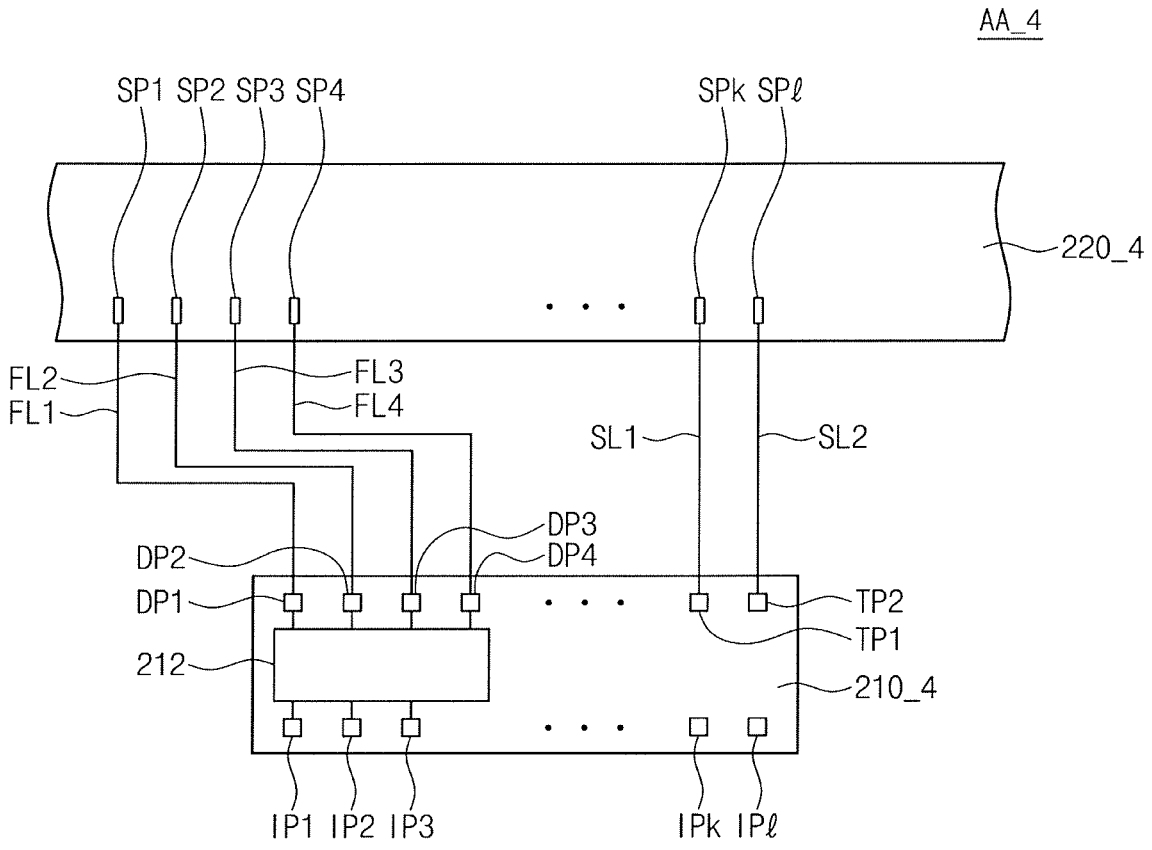
FIG. 12 is a plan view illustrating a display driver device of FIG. 2, according to an embodiment of the inventive concept.

FIG. 12 is an enlarged plan view illustrating another modification of the region AA_4 of the display driver device shown in FIG. 2.

Referring to FIG. 12, the display driver device 200 includes a timing controller 210_4, a display driver IC 220_4, first to fourth test lines FL1, FL2, FL3 and FL4, and first and second connection lines SL1 and SL2. The timing controller 210_4 includes first to $l^{th}$ receive pad units IP1, IP2, IP3, . . . IPk, and IPl, first to fourth dummy pad units DP1 to DP4, output pad units TP1 and TP2, and a test mode control unit 212. The test mode control unit 212 is electrically connected with the first to third receive pad units IP1 to IP3, and is electrically connected with the first to fourth dummy pad units DP1 to DP4. The number of the first to third pad units IP1 to IP3 electrically connected with the test mode control unit 212 is less than the number of the first to fourth dummy pads DP1 to DP4 electrically connected with the test mode control unit 212, which is different from the configuration of FIG. 10.

Figure 13:
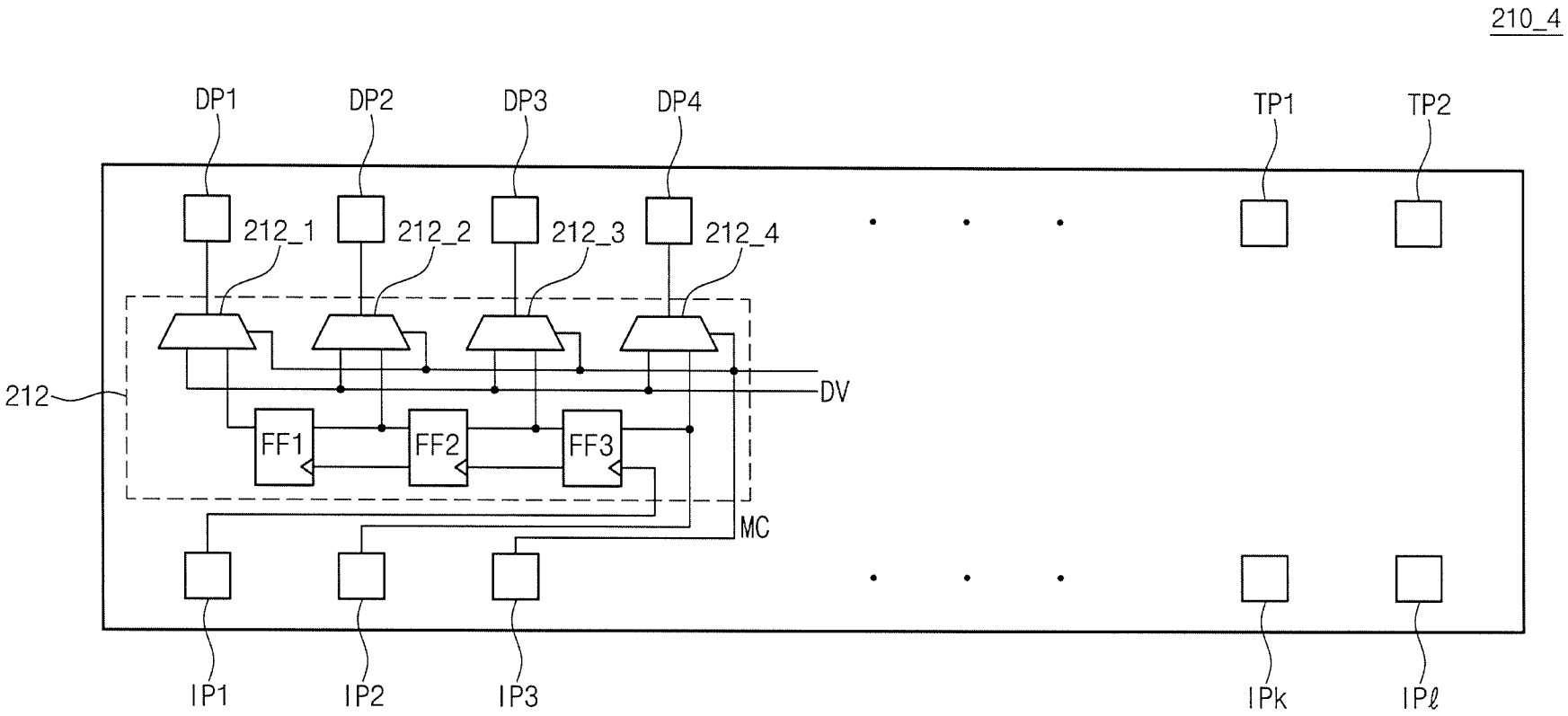
FIG. 13 is a detailed view illustrating a timing controller of FIG. 12.

FIG. 13 is a detailed view illustrating the timing controller of FIG. 12.

Referring to FIG. 13, the test mode control unit 212 includes first to fourth multiplexers 212_1 to 212_4 and first to third flip-flops FF1, FF2 and FF3. The number of the multiplexers included in the test mode control unit 212 may correspond to the number of the dummy pad units connected with the test mode control unit 212. Each of the first to fourth multiplexers 212_1 to 212_4 may include at least two input terminals, a control terminal, and an output terminal. Although the first to third flip-flops FF1 to FF3 are provided in the form of D flip-flops for an illustrative purpose, the embodiment is not limited thereto. Each of the first to third flip-flops FF1 to FF3 may include, for example, a clock input terminal, a data input terminal, and an output terminal.

In each of the first to third flip-flops FF1 to FF3, the clock input terminal is electrically connected with the first receive pad unit IP1. The first receive pad unit IP1 receives a clock signal from an external device and provides the clock signal to the first to third flip-flops FF1 to FF3. In the first to third flip-flops FF1 to FF3, data present at the input terminal is provided to the output terminal in response to the clock signal.

The second receive pad unit IP2 is electrically connected with the input terminal of the third flip-flop FF3. The output terminal of the third flip-flop FF3 is electrically connected with the input terminal of the second flip-flop FF2. The output terminal of the second flip-flop FF2 is electrically connected with the input terminal of the first flip-flop FF1. The second receive pad unit IP2 receives a test signal from the outside. For example, clock pulses are generated at a predetermined period. In this case, the third flip-flop FF3 receives the test signal at the rising edge of a first clock pulse. At the rising edge of a second clock pulse, the second flip-flop FF2 receives the test signal from the third flip-flop FF3. At the rising edge of a third clock pulse, the first flip-flop FF1 receives the test signal from the second flip-flop FF2. In other words, the first to third flip-flops FF1 to FF3 may sequentially receive the test signal.

The second receive pad unit IP2 is electrically connected with one of the at least two input terminals of the fourth multiplexer 212_4. The output terminal of the third flip-flop FF3 is electrically connected with one of the at least two terminals of the third multiplexer 212_3. The output terminal of the second flip-flop FF2 is electrically connected with one of the at least two terminals of the second multiplexer 212_2. The output terminal of the first flip-flop FF1 is electrically connected with one of the at least two terminals of the first multiplexer 212_1. The first to third flip-flops FF1 to FF3 are configured to sequentially provide the test signal to the input terminals of the first to third multiplexers 212_1 to 212_3. The test signal may be serial data. The first to fourth multiplexers 212_1 to 212_4 may receive a relevant part of the serial data in response to the clock signal such that the serial data is used to test the display driver IC 220_4. In this case, when the configuration of the test mode control unit 212 of FIG. 13 is compared with the configuration of the test mode control unit 211 of FIG. 11, the display driver IC 220_4 may sufficiently perform the test operation even though the number of receive pad units is reduced.

A different one of the at least two terminals of the first to fourth multiplexers 212_1 to 212_4 is provided with a default value DV. The DV may be zero. The control terminal of each of the first to fourth multiplexer 212_1 to 212_4 is electrically connected with the third receive pad unit IP3 and provided with the mode control signal MC. The mode control signal MC includes a test mode signal. When the test mode signal is provided to the control terminals of the first to fourth multiplexers 212_1 to 212_4, the first to fourth multiplexers 212_1 to 212_4 outputs the test signal through the respective output terminals. When the test mode signal is not provided to the control terminals of the first to fourth multiplexers 212_1 to 212_4, the first to fourth multiplexers 212_1 to 212_4 output the DV. In other words, the test mode control unit 212 determines, based on the mode control signal MC, whether the display driver IC 220_4 is tested.

Figure 14:
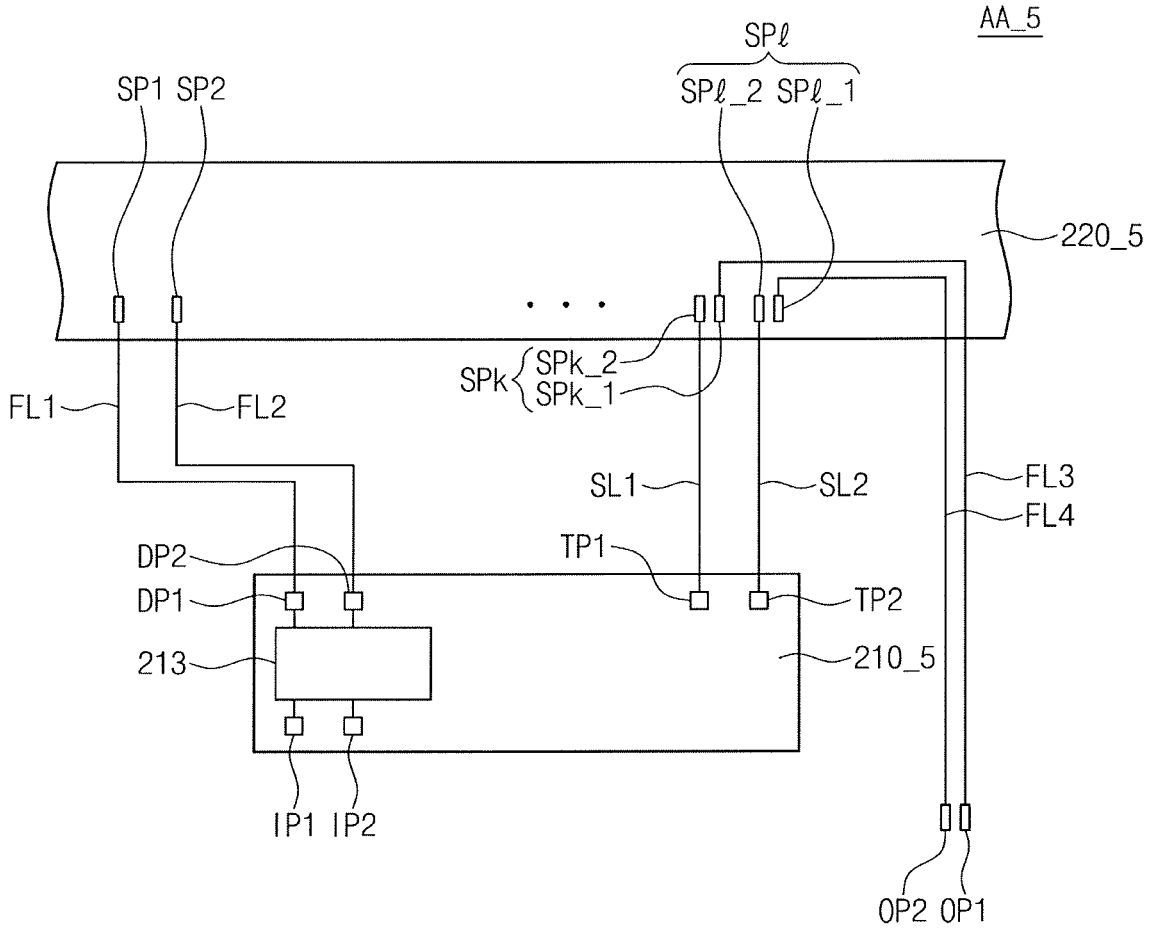
FIG. 14 is a plan view illustrating a display driver device of FIG. 2, according to an embodiment of the inventive concept.

FIG. 14 is an enlarged plan view illustrating another modification of the region AA_5 of the display driver device shown in FIG. 2.

Referring to FIG. 14, the display driver device 200 includes a timing controller 210_5, a display driver IC 220_5, first to fourth test lines FL1 to FL4, and first and second connection lines SL1 and SL2.

The timing controller 210_5 includes first and second receive pad units IP1 and IP2, first and second dummy pad units DP1 and DP2, output pad units TP1 and TP2, and a test mode control unit 213. The test mode control unit 213 may have the substantially same configuration as that of the test mode control unit 211 of FIG. 8 or the test mode control unit 212 of FIG. 10, and may perform the substantially same function as that of the test mode control unit 211 of FIG. 8 or the test mode control unit 212 of FIG. 10.

The display driver IC 220_5 includes first to $l^{th}$ input pad units SP1, SP2, SP3, . . . SPk, and SPl. The first and second input pad units SP1 and SP2 may receive test signals, which are received by the first and second receive pad units IP1 and IP2, in the test mode. The $k^{th}$ input pad unit SPk and the $l^{th}$ input pad unit SPl include test input pad units SPk_l and SPl_l and driving input pad units SPk_2 and SPl_2. The $k^{th}$ input pad unit SPk and the $l^{th}$ input pad unit SPl correspond to the first input pad unit SP1 and the second input pad unit SP2 of FIG. 3, respectively. The $k^{th}$ input pad unit SPk and the $l^{th}$ input pad unit SPl may include switch units. In the normal mode, the $k^{th}$ input pad unit SPk and the $l^{th}$ input pad unit SPl may receive image data or control signals from the first and second connection lines SL1 and SL2. In the test mode, the $k^{th}$ input pad unit SPk and the $l^{th}$ input pad unit SPl may receive test signals from the third and fourth test lines FL3 and FL4.

The test mode may include a first test mode and a second test mode. The test mode control unit 213 receives a test mode signal for the first test mode and provides test signals to the first and second input pad units SP1 and SP2. The $k^{th}$ input pad unit SPk and the $l^{th}$ input pad unit SPl receive a test mode signal for the second test mode and receive test signals from the third and fourth test lines FL3 and FL4.

As described above, according to an embodiment of the inventive concept, as the display driver device can facilitate access to the display driver integrated circuit in the test mode, the test time may be reduced. According to an embodiment, the size of the display driver device may be reduced by optimizing the placement of the lines for the test of the display driver device or minimizing the number of the lines, that may result in reduced manufacturing costs.

Although the exemplary embodiments of the inventive concept have been described, it is understood that the inventive concept should not be limited to these exemplary embodiments but various changes and modifications can be made by one ordinary skilled in the art within the spirit and scope of the inventive concept as hereinafter claimed.

What is claimed is:

1. A display driver device comprising:

a timing controller including an output pad unit;

a display driver integrated circuit including an input pad unit and an internal circuit configured to generate a data voltage based on image data and a control signal received from the timing controller;

a flexible printed circuit board on which at least one of the timing controller and the display driver integrated circuit are mounted;

a connection line formed at the flexible printed circuit board that electrically connects the timing controller to the display driver integrated circuit in which one end of the connection line is connected with the input pad unit and an opposite end of the connection line is connected with the output pad unit; and a test line formed at the flexible printed circuit board and comprising one end connected with the input pad unit and an opposite end connected to receive a test signal for testing the display driver integrated circuit, wherein the display driver device operates in a normal mode or in a test mode based on a test mode signal, wherein the internal circuit of the display driver integrated circuit receives the image data from the timing controller through the connection line and the input pad unit in the normal mode, and wherein the internal circuit of the display driver integrated circuit receives the test signal through the test line and the input pad unit and is blocked from receiving the image data through the connection line in the test mode.

2. The display driver device of claim 1, wherein the display driver integrated circuit further includes an additional pad input unit that receives the test mode signal from an external source.

3. The display driver device of claim 1, wherein the input pad unit comprises:

a test input bump connected with the one end of the test line; and a driving input bump connected with the one end of the connection line, and wherein the test input bump is separated from the driving input bump.

4. The display driver device of claim 3, further comprising a switch that electrically separates the test input bump from the driving input bump, and wherein in a timing controller test mode, a timing controller test signal input to the test input bump is provided to the timing controller via the driving input bump exclusive of the display driver integrated circuit.

5. The display driver device of claim 3, wherein the display driver integrated circuit further comprises:

an internal line connected with the internal circuit which converts the image data into the data voltage, and wherein the input pad unit further comprises:

a switch unit configured to electrically connect the internal line with the driving input bump in the normal mode and configured to electrically connect the internal line with the test input bump in the test mode.

6. The display driver device of claim 5, wherein the switch unit comprises:

a first switch comprising one end connected with the test input bump and an opposite end connected with the internal line; and a second switch comprising one end connected with the driving input bump and an opposite end connected with the internal line and the opposite end of the first switch, wherein, in the normal mode, the first switch is switched off and the second switch is switched on, and wherein, in the test mode, the first switch is switched on and the second switch is switched off.

7. The display driver device of claim 5, wherein the switch unit electrically connects the internal line with the test input bump in the test mode in response to the test mode signal.

8. The display driver device of claim 1, wherein the timing controller further comprises:

a test mode control unit connected with the output pad unit and configured to receive the test mode signal for the test mode.

9. The display driver device of claim 8, wherein the test mode control unit comprises:

a tri-state buffer comprising an output terminal connected with the output pad unit and a control terminal connected to receive the test mode signal.

10. The display driver device of claim 9, wherein the test mode control unit receives image data and provides the image data to the output pad unit in the normal mode, and wherein the test mode control unit blocks an output of the image data in the test mode in response to the test mode signal.

11. The display driver device of claim 8, wherein the timing controller further comprises:

a receive pad unit electrically connected with the test mode control unit and configured to provide the test signal to the test mode control unit in the test mode; and a dummy pad unit electrically connected with the test mode control unit and configured to provide the test signal to the test line in the test mode.

12. The display driver device of claim 11, wherein the test mode control unit comprises:

a multiplexer comprising an input terminal configured to receive the test signal from the receive pad unit, a control terminal configured to receive the test mode signal, and an output terminal connected with the dummy pad unit.

13. The display driver device of claim 12, wherein the multiplexer outputs the test signal received from the receive pad unit in the test mode and outputs a default value in the normal mode.

14. The display driver device of claim 12, wherein the input pad unit comprises a first input pad unit and a second input pad unit, wherein the test line comprises a first test line electrically connected with the first input pad unit and a second test line electrically connected with the second input pad unit, wherein the dummy pad unit comprises a first dummy pad unit electrically connected with the first test line and a second dummy pad unit electrically connected with the second test line, wherein the multiplexer comprises a first multiplexer electrically connected with the first dummy pad unit and a second multiplexer electrically connected with the second dummy pad unit, and wherein the test mode control unit further comprises:

a flip-flop which sequentially provides the test signal to the first multiplexer and the second multiplexer.

15. The display driver device of claim 1, further comprising:

a test pad unit connected with the opposite end of the test line and configured to provide the test signal to the test line in the test mode;

a first line and a second line, each of which has one end electrically connected with the display driver integrated circuit;

a first pad unit connected with an opposite end of the first line; and a second pad unit connected with an opposite end of the second line, wherein the test pad unit is interposed between the first line and the second line.

16. The display driver device of claim 15, wherein an area of the test pad unit is smaller than an area of each of the first pad unit and the second pad unit.

* * * * *